United States Patent [19]

Melbert

[11] Patent Number: 4,633,162

[45] Date of Patent: Dec. 30, 1986

[54] SERIES VOLTAGE REGULATOR EMPLOYING A VARIABLE REFERENCE VOLTAGE

[75] Inventor: Joachim G. Melbert, Steinhöring, Fed. Rep. of Germany

[73] Assignee: SGS-ATES Deutschland Halbleiter Bauelement GmbH, Grafing, Fed. Rep. of Germany

[21] Appl. No.: 669,738

[22] Filed: Nov. 7, 1984

[30] Foreign Application Priority Data

Nov. 15, 1983 [DE] Fed. Rep. of Germany ..... 3341344

[51] Int. Cl.[4] ..... G05F 1/56

[52] U.S. Cl. ..... 323/275; 361/18

[58] Field of Search ..... 323/275, 276, 279, 282, 323/299, 303, 908; 361/18, 86, 88

[56] References Cited

U.S. PATENT DOCUMENTS 3,534,249 10/1970 Neill et al. ..... 361/18

3,916,294 10/1975 Kennedy ..... 361/18

FOREIGN PATENT DOCUMENTS 2700111 7/1978 Fed. Rep. of Germany .

1434170 5/1976 United Kingdom ..... 323/303

OTHER PUBLICATIONS

L. Büttner, "Entwurf Transistorisierter Gleichspannungskonstanthalter", 1965, Funk-Technik, No. 23, pp. 947-950.

*Primary Examiner*—Patrick R. Salce

*Assistant Examiner*—D. L. Rebsch

*Attorney, Agent, or Firm*—Spencer & Frank

[57] ABSTRACT

In a series voltage regulator having a regulating transistor (T) arranged with its emitter-to-collector path in a series arm of the regulator, the base of this regulating transistor being controlled by a differential amplifier (V) which compares a voltage proportional to the regulator output voltage ($U_2$) with a reference voltage ($U_C$), this reference voltage is available from a capacitor (C) to which a voltage limiting circuit (B) limiting the reference voltage to a maximum level ($U_R$) is assigned, and which is connected to the output of a transconductance circuit (G) whose output current ($I_A$) depends on the difference ($U_D$) between the output voltage ($U_2$) and the input voltage ($U_1$) of the series voltage regulator.

24 Claims, 4 Drawing Figures

(PRIOR ART)

SERIES VOLTAGE REGULATOR EMPLOYING A VARIABLE REFERENCE VOLTAGE

BACKGROUND OF THE INVENTION

The present invention relates to a series voltage regulator as in the introductory part of claim 1.

A conventional series voltage regulator, as known from FIG. 1 of DE-OS No. 2,700,111 and as shown in FIG. 1 of the subject application, is used for supplying a load with a stabilized direct voltage. In order for the nominal output voltage of the series voltage regulator to be obtained, its input voltage must exceed a certain critical level. If the input voltage falls below this critical level, the differential amplifier drives the regulating transistor into a saturated state. Due to the low collector-to-emitter saturation resistance of regulating transistor T, interference voltage, for example interference alternating voltage, may reach the regulator output virtually unimpeded in this saturation state. Suppression of interference thus occurs only in the normal voltage range, i.e. at input voltages higher than the critical level at which the nominal voltage can be reached on the output side.

In various applications, e.g. for car radios, suppression of the alternating voltage portions of the input signal is necessary in addition to the stabilization of the direct voltage mean value at the output of the series voltage regulator.

For this purpose, series voltage regulators, as known from FIGS. 2 and 3 of DE-OS No. 2,700,111 and from FUNK-TECHNIK 1965, No. 23, pages 947 to 950, comprise an RC low-pass filter, with the R thereof being constituted by the resistance of the collector-to-emitter path of the regulating transistor and the C thereof being constituted by a capacitor connected in parallel to the output of the series voltage regulator. When the capacitance value of this capacitor is fixed, the filtering effect of such a low-pass filter decreases as R decreases. Due to the fact that in case of these known series voltage regulators the low-pass filter is dimensioned for the normal voltage range, in which the resistance R of the collector-to-emitter path of the regulating transistor is high, the filtering effect of this low-pass filter deteriorates significantly when the regulating transistor goes into the saturation state in the undervoltage range on the input side of the series voltage regulator and the resistance R constituted by said regulating transistor still is only very low. Thus, these known series voltage regulators fulfill the suppression of interference at the most in the range of normal input voltages, but not in the undervoltage range on the input side, in which the output voltage no longer reaches its nominal value and the regulating transistor goes into the saturation state.

Suppression of interference also in the undervoltage range may be achieved by arranging a conventional RC low-pass filter subsequent to such a series voltage regulator. However, this involves additional expenditure and additional power dissipation in the resistor of this additional RC low-pass filter. Discrete circuits of a transistor/Zener diode/capacitor combination lead to unsatisfactory approximate solutions.

A series voltage regulator as it is known from U.S. Pat. No. 3,916,294, comprises a first capacitor on the input side, which serves for attenuating interfering alternating voltage portions of the input voltage. A second capacitor is connected in parallel to a Zener diode which is connected on the one hand to the emitter of a transistor constituting a differential amplifier and on the other hand to a voltage divider which is connected in parallel to the output of the series voltage regulator. This second capacitor serves for attentuating alternating voltage portions present in the output voltage of the series voltage regulator in order to reduce their effect on the regulation of the regulating transistor. If in case of this known series voltage regulator the regulating transistor comes into the saturation state in undervoltage operation on the input side, the interference signals reaching this regulating transistor reach the output of the series voltage regulator virtually unimpeded.

SUMMARY OF THE INVENTION

The invention is based on the problem of improving the series voltage regulator of the type mentioned at the outset, so as to allow for reliable suppression of interference in the entire input voltage range, in a manner which is as simple and power-saving as possible.

A solution to this problem is stated in claim 1 and may be advantageously developed in accordance with the subclaims.

The series voltage regulator known from the aforementioned publication in FUNK-TECHNIK comprises a so-called preregulator which in fact is in connection with the input voltage side and the output voltage side of the series voltage regulator; however, the currents thereof are constant, i.e. independent of the input and output voltages.

The invention makes available a series voltage regulator which unites the function of a regulator in the normal voltage range with the function of a low-pass filter in the undervoltage range, the voltage drop at the regulator being current-independent for the low-pass operation.

The inventive series voltage regulator has a low-pass character in the undervoltage range, without the disadvantages of a constant ohmic series resistor.

In the normal voltage range a difference comes about between the input voltage and the output voltage, which at the output of the transconductance circuit causes a current which increasingly charges the capacitor until the capacitor's charging voltage is limited to a maximum level by the voltage limiting circuit. As long as the input voltage is so great that not even negative interference peaks of a limited amplitude put the regulating transistor into the saturation state, the series voltage regulator shows its usual regulating behavior. However, as soon as negative interference peaks occur during which the regulating transistor could go into the saturation state, which is detected on the basis of the difference between the input voltage and the output voltage, the output voltage of the series regulating amplifier is regulated down to a lower level in such a way that the regulating transistor subsequently does not go into the saturation state even during such negative interference peaks. This is effected by reversing the current flowing at the output of the transconductance circuit, at a differential voltage between the input and the output of the series voltage regulator, below which the regulating transistor would be put into the saturation state by interference. This causes the capacitor to be discharged, thereby reducing the reference voltage of the differential amplifier and consequently the regulator output voltage is regulated down to a "reduced nominal level". The decrease in the output voltage causes the difference between the input and the output voltage to resume a level at which the regulating transistor cannot be put in the saturation state by interference, on the one hand, and the current at the output of the transconductance circuit returns to 0, on the other hand. If the input voltage rises again afterwards, the current at the output of the transconductance circuit can again reverse its direction and charge the capacitor again to reach a higher reference voltage.

The downward regulation of the output voltage below the nominal level also takes place when the input voltage is in the undervoltage range in terms of direct voltage.

In the inventive series voltage regulator which works with a variably controllable reference voltage, interference voltage at the input is evaded in a certain sense, by reducing the direct voltage level of the series voltage regulator on the output side. Such a change in the direct voltage mean value at the output of the series voltage regulator is generally coped with by loads supplied by the series voltage regulator, since they are usually designed to function in a wide range of the supply voltage. But such loads could usually not cope with interference voltage, for example hum voltage, etc. When the inventive measures are taken, they no longer need to do this, not even in the undervoltage range on the input side of the series voltage regulator.

In order that a large charging time constant and thus a good filter effect of the low-pass function of the series voltage regulator be obtained even in the case of a relatively small capacitor, the transconductance of the transconductance circuit is made to be as small as possible. A transconductance circuit with linear transconductance behavior is preferably used. In a particularly preferred embodiment of the invention, a transconductance characteristic is used which has low-value linear transconductance between a lower and an upper threshold of the difference between the regulator input voltage and the regulator output voltage, and large transductance both below the lower threshold and above the upper threshold. Due to the high transconductance, the low-pass filter behavior of the series voltage regulator is in fact impaired below the lower threshold and above the upper threshold. But a fast reaction of the series voltage regulator to high negative interference voltage is thereby obtained, on the one hand, and fast charging of the capacitor to its normal operating voltage when the series voltage regulator is switched on, and thus a short building-up time of the series voltage regulator, on the other hand.

The transconductance circuit is preferably designed as a differential amplifier, one input of which is connected to the regulator input and the other input of which is connected to the regulator output. An auxiliary voltage source is preferably connected between one input of this differential amplifier and the regulator input, the voltage level of this auxiliary voltage source being such that the output current of the transconductance circuit is reversed and causes the capacitor to be discharged before the regulating transistor goes into the saturation state. The auxiliary voltage source may be a constant voltage source or a voltage source with a variable voltage level which is controlled in accordance with the output current of the series voltage regulator, as described in more detail in a simultaneously filed patent application based on West-German patent application P No. 33 41 345. U.S. Ser. No. 06/669,737) which is directed to the prevention of excessive starting current of a series voltage regulator and whose disclosure is hereby being made part of the disclosure of the present application by express reference. Instead of this auxiliary voltage source one might also use for the transconductance circuit a differential amplifier unit which behaves asymmetrically, in such a way that the current at the output of the transconductance circuit is not only reversed in the direction discharging the capacitor when the difference between the two voltages at the input of this differential amplifier unit have reversed their polarity accordingly, but as soon as this difference falls below a certain positive threshold. This positive threshold corresponds to the level of the auxiliary voltage source.

In a particularly preferred embodiment, a differential amplifier with two transistors is used for the transconductance circuit, whose base terminals are connected to the auxiliary voltage source and the output of the series voltage regulators, respectively, whose emitter terminals are connected to each other via an emitter impedance and each connected to a current source, and whose collectors are connected to two inputs of a summing circuit whose output delivers the output current of the transconductance circuit which flows to the capacitor or out of the capacitor. The summing circuit preferably includes a current mirror circuit whose input is connected to the collector of one of the two transistors and whose output is connected to a connecting point between the capacitor and the collector of the other of the two transistors.

In order that a very low transconductance is obtained in the normal operating range, the two transistors of the differential amplifier of the transconductance circuit, in addition to having the current-controlled negative feedback in the emitter arm, are preferably each designed as a multi-transistor with two collectors. The two collectors of each of these multi-transistors have different collector areas. The collectors with the smaller collector area are connected to the summing circuit so that the collector current portions delivered to the summing circuit are low, constituting approximately 10% of the entire collector current of each transistor in the selected example.

The increase of transconductance outside the linear range may be realized by one auxiliary transistor in each case, which is only activated in the case of sufficient modulation of the transconductance circuit.

The inventive series voltage regulator is preferably constructed completely with bipolar transistors. However, field-effect transistors may also be used for at least some of the transistors of the series voltage regulator.

The inventive series voltage regulator is preferably formed on one monolithically integrated circuit. The capacitor may be left out of this monolithic integration. Due to the possibility of providing very low transconductance, one can manage with a relatively small capacitor.

The invention as well as advantages and developments of the invention shall now be explained in more detail with reference to embodiments.

DESCRIPTION OF THE PREFERRED EMBODIMENTS

Figure 1:
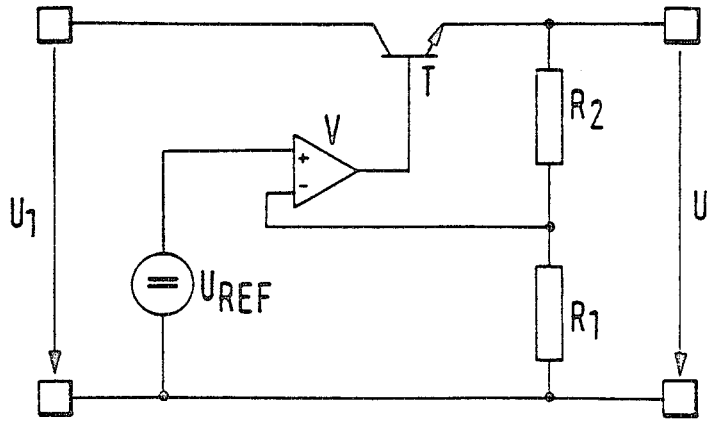
FIG. 1 is a schematic diagram illustrating the structure of a conventional series voltage regulator.

The conventional series voltage regulator shown in FIG. 1 has a regulating transistor T in common base configuration in its upper series arm. The output of the series voltage regulator is bridged by a voltage divider with two resistors $R_1$ and $R_2$. The base of regulating transistor T is connected to the output of a differential amplifier V whose inverting input is connected to the divisional voltage point of the voltage divider and whose non-inverting input is connected to a reference voltage source $U_{REF}$.

In the case of sufficiently high input voltage $U_1$, the differential amplifier V can set such an output voltage $U_2$ via regulating transistor T that the voltage across lower resistance $R_1$ of the voltage divider reaches the level of reference voltage $U_{REF}$. Output voltage $U_2$ assumes its nominal level then.

Below a certain critical level of input voltage $U_1$ it is no longer possible to regulate output voltage $U_2$ to its nominal value. When attempting to regulate the output voltage to the nominal voltage corresponding to reference voltage $U_{REF}$, differential amplifier V puts regulating transistor T into the saturation state. Interference voltage, for example in the form of alternating voltage, then reaches the output virtually unobstructed due to the low resistance of the collector-to-emitter path of the saturated regulation transistor, having a disturbing effect in the load connected to the series voltage regulator.

Figure 2:
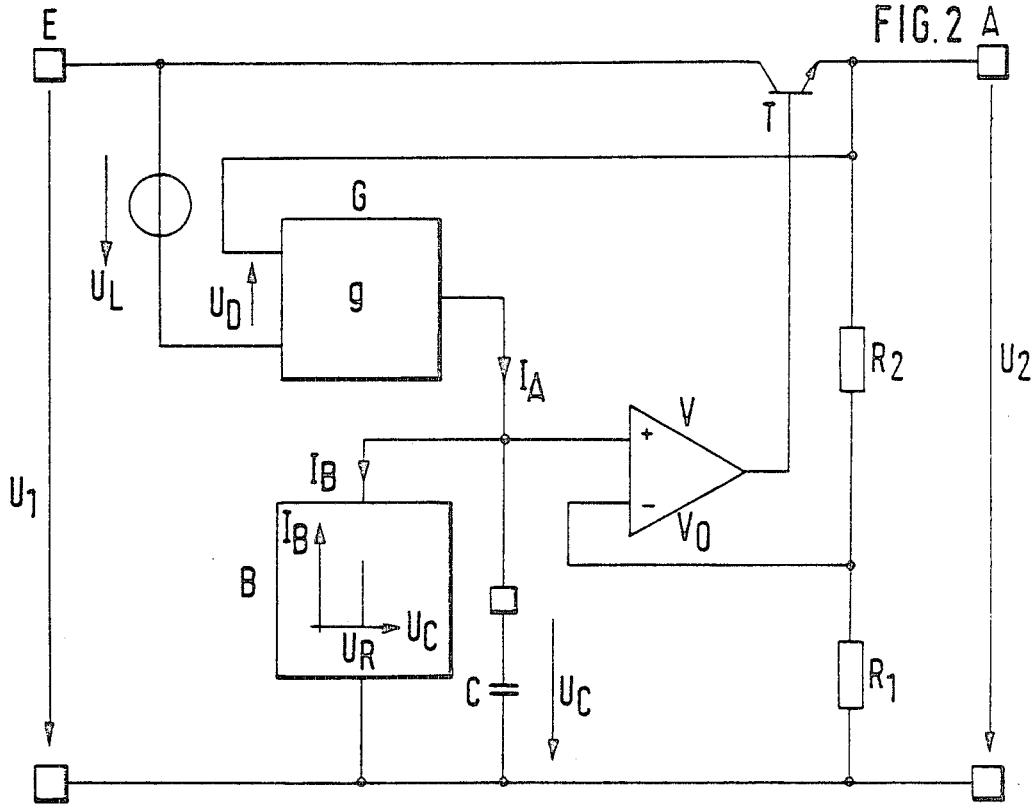
FIG. 2 is a schematic diagram illustrating the basic structure of the series voltage regulator of the present invention.

The embodiment of an inventive series voltage regulator shown in FIG. 2 includes a circuit means which is identical to the conventional series voltage regulator, if the reference voltage source is disregarded. Instead of the reference voltage source $U_{REF}$ which delivers constant voltage in the conventional series voltage regulator, the inventive series voltage regulator comprises a controlled reference voltage source. The latter contains a capacitor C which is connected at one end to the non-inverting input of differential amplifier V and at the other end to the lower through-connected series arm of the series voltage regulator. Parallel to capacitor C a voltage limiting circuit B is arranged in the form of a Zener diode or an active limiting circuit. The output of a transconductance circuit G is also connected to the end of capacitor C which is connected to differential amplifier V, this transconductance circuit being designed as a differential circuit whose first input is connected via an auxiliary voltage source $U_L$ to the input connection E of the series voltage regulator, which is shown at the top in FIG. 2, and whose second input is connected to the output connection A of the series voltage regulator, also shown at the top in FIG. 2.

In this inventive series voltage regulator as well, differential amplifier V having a voltage amplification $v_0$, together with regulating transistor T designed as a power transistor, as the series regulating element with, and the negative feedback resistors of, voltage divider $R_1$, $R_2$, forms the regulating amplifier. When $v_0 >> R_2/R_1$, the following holds:

$$U_2 = \left(1 + \frac{R_2}{R_1}\right) U_C. \tag{1}$$

$U_C$, the charging voltage of capacitor C, is controlled by transconductance circuit G. In the case of positive output current $I_A$ of the transconductance circuit, capacitor C is charged until it reaches critical voltage $U_R$, to which voltage limiting circuit B limits capacitor voltage $U_C$. Output voltage $U_2$ of the series voltage regulator then has its nominal level:

$$U_2 = U_{2\,NOM} = U_R\left(1 + \frac{R_2}{R_1}\right). \tag{2}$$

Current $I_A$ is determined by $$I_A = g \cdot U_D. \tag{3}$$

g is the effective transconductance and $U_D$ the control voltage of G, whereby $$U_D = U_1 - (U_2 + U_L). \tag{4}$$

$U_L$ is a constant auxiliary voltage.

In the case of $$U_1 \geqq U_{2\,NOM} + U_L \tag{5}$$

a differential voltage $$U_D \geqq 0$$

is obtained at a nominal output voltage $U_{2\,NOM}$ in accordance with Equation (2) between the two inputs of transconductance circuit G. In this operating range an output voltage $$I_A \geqq 0$$

occurs at the output of transconductance circuit G.

When the series voltage regulator comes into the undervoltage range, i.e. the range of smaller input voltage for which $$U_1 < U_{2\,NOM} + U_L \tag{6}$$

holds, differential voltage $U_D$ becomes negative between the two inputs of transconductance circuit G. This leads to a reversal of output current $I_A$ of transconductance circuit G, so that capacitor C is discharged. When capacitor voltage $U_C$ falls below critical level $U_R$, output voltage $U_2$ of the series voltage regulator is regulated down to a lower level than $U_{2\,NOM}$. Transconductance circuit G acts as an "auxiliary regulator" changing capacitor voltage $U_C$ in such a way that differential voltage $U_D$ disappears in the steady-state condition at which output current $I_A$ is equal to 0, and the relation $$U_1 = U_L + U_2 \tag{7}$$

holds.

In the operating range $I_A > 0$, i.e. the normal voltage range in which nominal voltage $U_{2\,NOM}$ can be reached at the output, the suppression of interference $$D = \frac{U_{1eff}}{U_{2eff}} \quad (8)$$

is infinite due to the negligibly low dynamic impedance of voltage limiting circuit B, and is virtually determined by the real behavior of the differential amplifier, i.e. by the sensitivity of differential amplifier V to interference in its supply voltage.

For the undervoltage operation of this series voltage regulator, the following holds in the linear transmission range g of transconductance circuit G for the suppression of interference:

$$D(p) = 1 + \frac{1}{g\frac{1}{pC}\left(1 + \frac{R_2}{R_1}\right)} \quad (9)$$

wherein $p = j\omega$.

Thus, the suppression of interference D in the undervoltage range can be determined by capacitor C and transconductance g. Auxiliary voltage $U_L$ determines the set value of the average series voltage across the collector-to-emitter path of the regulating transistor in undervoltage operation, at which "auxiliary regulator" G intervenes in the regulating process, and should be designed in such a way that the maximal negative interference amplitudes of the input voltage, which cannot be regulated out due to the delay in the regulating circuit, do not drive regulating transistor T into the saturation state.

The dynamic behavior of the circuit may be influenced in an appropriate manner by a non-linear transmission behavior g of transconductance circuit G.

Figure 3:
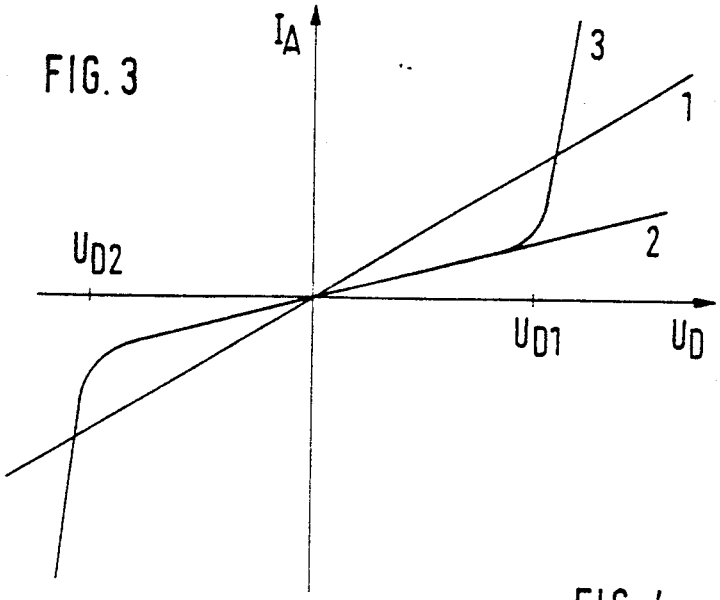
FIG. 3 is a graph illustrating the transmission characteristics of various embodiments of the transconductance circuit of the series voltage regulator as in FIG. 2.

FIG. 3 shows several transconductance characteristics g. Characteristic 1 characterizes the above-mentioned linear case.

Characteristic 2 is not as steep as characteristic 1 in the range $U_D > U_{D2}$ and is much steeper in the range $U_D < U_{D2}$. $U_{D2}$ is a lower threshold of $U_D$. In the case of negative interference which falls below lower threshold $U_{D2}$, the extreme steepness of the transconductance characteristic leads to an intense capacitor discharging current. The circuit therefore reacts quickly to such great interference. The reduced steepness above lower threshold $U_{D2}$ increases the filter time constant, thereby improving the filter behavior.

Characteristic 3 is also very steep above an upper threshold $U_D > U_{D1}$. When such a characteristic if used, the building-up time of the circuit may be reduced, especially after it is switched on. In case output voltage $U_2$ is so much lower than input voltage $U_1$ that $U_D > U_{D1}$, current $I_A$ flowing into capacitor C increases sharply, ensuring quick charging of capacitor C, so that nominal voltage $U_{2\,NOM}$ may be quickly reached at the output.

Figure 4:
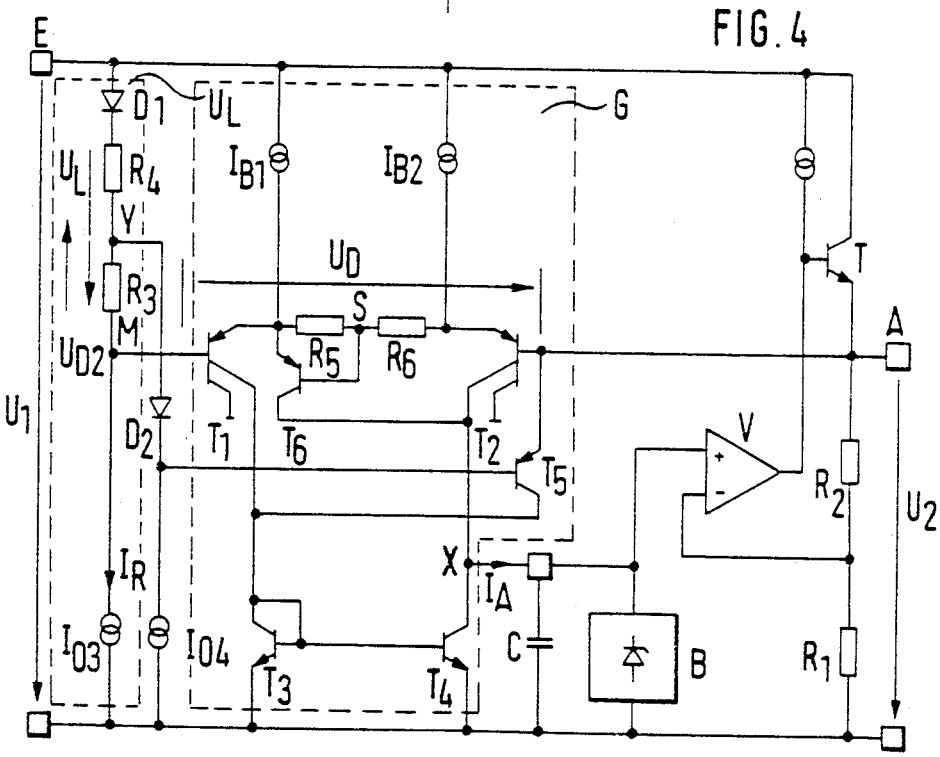
FIG. 4 is a schematic diagram illustrating a particularly preferred embodiment of the transconductance circuit and the auxiliary voltage source of the series voltage regulator as in FIG. 2.

A preferred embodiment of the inventive series voltage regulator, which is particularly suitable for monolithic integration, is shown in FIG. 4. This embodiment exhibits a non-linear transconductance circuit in accordance with characteristic 3 in FIG. 3.

Transconductance circuit G and auxiliary voltage source $U_L$ are each shown in FIG. 4 by a dotted block.

Auxiliary voltage source $U_L$ exhibits a series arrangement connected in parallel to the input of the series voltage regulator and comprises a diode $D_1$, a resistor $R_3$, a resistor $R_4$ and a current source $I_{03}$. Constant current $I_R$ delivered by current source $I_{03}$ leads to a constant voltage drop $U_L$ across the series arrangement comprising diode $D_1$ and the two resistors $R_3$ and $R_4$. The auxiliary voltage is available at connecting point M between lower resistor $R_3$ and current source $I_{03}$.

Transconductance circuit G includes a differential amplifier circuit having a first transistor $T_1$ and a second transistor $T_2$. The base of first transistor $T_1$ is connected to connecting point M of auxiliary voltage source $U_L$. The base of second transistor $T_2$ is connected to output connection A connected to the emitter of regulating transistor T. The emitter of first transistor $T_1$ is connected via a current source $I_{B1}$, and the emitter of second transistor $T_2$ is connected via a current source $I_{B2}$, to input connection E connected to the collector of regulating transistor T. Furthermore, the emitters of the two transistors $T_1$ and $T_2$ are connected via a voltage divider comprising two resistors $R_5$ and $R_6$.

The two transistors $T_1$ and $T_2$ are each designed as a multi-transistor, each having an auxiliary collector being connected to ground and each having a main collector being connected to an arm of a current mirror circuit with a transistor $T_3$ switched as a diode and a further transistor $T_4$. Due to corresponding selection of the ratio of the auxiliary collector area to the main collector area, the collector currents from the main collectors of the two transistors $T_1$ and $T_2$ are only a fraction of the overall collector current, only approximately 10% in the stated example. Due to this measure, a very low level of transconductance g $$g = 0.1\frac{1}{R_5 + R_6} \quad (10)$$

is obtained.

In the embodiment shown in FIG. 4, the summing circuit, at the output of which current $I_A$ is made available, is formed by the already-mentioned current mirror circuit with transistors $T_3$ and $T_4$. The current coming from the main collector of transistor $T_1$ flows into the input of the current mirror circuit, located at the collector of transistor $T_3$ and is added at the output of the current mirror circuit, formed by the collector of transistor $T_4$, at connecting point X, to the current coming from the main collector of transistor $T_2$. The current resulting from this addition is the output current $I_A$ of transconductance circuit G.

The increase of transconductance when lower threshold $U_{D2}$ is fallen short of, as shown in characteristic 2 in FIG. 3, is effected, with a transistor $T_5$ whose emitter-to-collector path is connected between the base of transistor $T_2$ and the main collector of transistor $T_1$, and whose base is connected via a diode $D_2$ to a connecting point Y between resistors $R_3$ and $R_4$ of auxiliary voltage source $U_L$. Lower threshold $U_{D2}$ is formed by the voltage drop at resistor $R_3$ of auxiliary voltage source $U_L$. The potential jump between the emitter and the base of transistor $T_5$ is compensated by diode $D_2$. When differential voltage $U_D$ between the base terminals of transistors $T_1$ and $T_2$ drops below lower threshold $U_{D2}$, transistor $T_5$ becomes conductive and feeds a high collector current into the input of current mirror circuit $T_3$, $T_4$. This current appears at output point X of the current mirror circuit and leads to a rapid discharge of capacitor C and thus to a downward regulation of output voltage $U_2$ of the series voltage regulator to a reduced direct voltage mean value.

Between the emitter of transistor $T_1$ and the main collector of transistor $T_2$ the emitter-to-collector path of a further transistor $T_6$ is connected whose base is connected to the connecting point between resistors $R_5$ and $R_6$. When differential voltage $U_D$ exceeds upper threshold $U_{D1}$, transistor $T_6$ becomes conductive and feeds a relatively large current into the connecting point X, in the opposite direction to the current fed in by transistor $T_5$. When transistor $T_6$ becomes conductive, a current $I_A$ thus flows from connecting point X into capacitor C, thereby charging capacitor C up to a maximum of limiting voltage $U_R$.

Transistors $T_1$ to $T_4$ form the transconductance circuit which works in the linear range between lower threshold $U_{D2}$ and upper threshold $U_{D1}$, under the condition $$I_{B1,2}\cdot(R_5+R_6)>U_{D1,2}. \tag{11}$$

Reference current $I^R$ of current source $I_{03}$ generates voltage drop $U_L$ at series connection $R_3$, $R_4$, $D_1$. By tapping at voltage divider point Y, voltage level $U_{D2}$ corresponding to the lower threshold is obtained. The following holds approximately for the voltage level corresponding to the upper threshold:

$$U_{D1} = \left(1 + \frac{R_6}{R_5}\right) U_{BE\,T6}. \tag{12}$$

Voltage limiting circuit B is symbolized in FIG. 4 as a Zener diode, but is preferably realized by an electronic limiting circuit.

The embodiment of the inventive series voltage regulator shown in FIG. 4 functions in the following manner. When input voltage $U_1$ is switched on, output voltage $U_2$ and capacitor voltage $U_C$ are initially 0, so that differential voltage $U_D$ is higher than upper threshold $U_{D1}$. Transistor $T_6$ therefore delivers a powerful collector current to connecting point X, so that capacitor C is charged by a strong output current $I_A$ of transconductance circuit G. Consequently, output voltage $U_2$ is increasingly regulated upward in the direction of nominal level $U_{2\,NOM}$. The increase in output voltage $U_2$ reduces differential voltage $U_D$ increasingly.

When upper threshold $U_{D1}$ is fallen short of, transistor $T_6$ switches off, so that only the linear transconductance circuit with transistors $T_1$ to $T_4$ remains effective. In the nominal operating state, a positive differential voltage $U_D$ remains due to the voltage drop across regulating transistor T, so that the current delivered by the main collector of transistor $T_2$ outweighs that delivered by the main collector of transistor $T_1$ via current mirror circuit $T_3$, $T_4$ and output current $I_A$ of transconductance circuit G flows continuously into capacitor C as the charging current. When limiting voltage $U_R$ is reached, the capacitor voltage remains constant in spite of this charging current $I_A$.

When the series voltage regulator comes into the undervoltage range continuously or during negative interference voltage peaks at the input, $U_1$ is smaller than the sum value of nominal voltage $U_{2\,NOM}$ on the output side and auxiliary voltage $U_L$ (Equation (6)), and the polarity of differential voltage $U_D$ is reversed. Then the current delivered by the main collector of transistor $T_1$ to current mirror circuit $T_3$, $T_4$ outweighs the current delivered by the main collector of transistor $T_2$, and the polarity of output current $I_A$ of transconductance circuit G is consequently reversed as well. This causes a reduction in the capacitor charge and thus a decrease in capacitor voltage $U_C$. Output voltage $U_2$ is therefore regulated down to a level lower than the nominal voltage via differential amplifier V.

A large time constant results for the change in capacitor voltage $U_C$ in the range of linear low transconductance g. In the case of negative amplitudes of interference voltage which fall below lower threshold $U_{D2}$ of differential voltage $U_D$, a strong current is fed into the input of current mirror circuit $T_3$, $T_4$ due to the switching of transistor $T_5$ into the conductive state, this strong current acting as a strong discharging current for capacitor C at connecting point X, the output point of transconductance circuit G. Thus, a rapid downward regulation of output voltage $U_2$ can be effected to a level at which differential voltage $U_D$ is again higher than lower threshold $U_{D2}$.

Due to its low-pass filter character in the undervoltage range, the inventive series voltage regulator thus protects the load it supplies against interference voltage in all operating ranges. The selection of a non-linear transconductance characteristic in the embodiment as in FIG. 4 additionally allows for the series voltage regulator to adjust rapidly to extreme operating situations.

What I claim is:

1. A series voltage regulator having a regulating transistor arranged with its emitter-to-collector path in a series arm of the regulator, the base of this regulating transistor being controlled by a differential amplifier which compares a voltage proportional to the regulator output voltage with a reference voltage, wherein the reference voltage is available from a capacitor to which a voltage limiting circuit which limits the reference voltage to a maximum level is associated and which is connected to the output of a transconductance circuit whose output current depends on the difference between the input voltage and the output voltage of the series voltage regulator.

2. The series voltage regulator as in claim 1, wherein the voltage limiting circuit is connected in parallel to the capacitor, this parallel connection is connected at one end to the series arm of the regulator which is not provided with the regulating transistor, and at the other end both to the non-inverting input of the differential amplifier and to the output of the transconductance circuit, and the inverting input of the differential, amplifier is connected to a tapping point of a first voltage divider connected in parallel to the regulator output.

3. The series voltage regulator as in claim 1, wherein the voltage limiting circuit is formed by a Zener diode connected in parallel to the capacitor.

4. The series voltage regualtor as in claim 1, wherein the voltage limiting circuit is formed by an electronically realized, active limiting circuit arrangement which is connected in parallel to the capacitor.

5. The series voltage regulator as in claim 1, wherein the transconductance circuit has a linear transconductance characteristic.

6. The series voltage regulator as in claim 1, wherein the transconductance circuit has a transconductance characteristic which has a low-value linear transconductance when the difference between the regulator input voltage and the regulator output voltage is above a lower threshold, and a large transconductance when this difference is below this lower threshold.

7. The series voltage regulator as in claim 1, wherein the transconductance circuit has a transconductance characteristic which has a low-value linear transconductance when the difference between the regulator input voltage and the regulator output voltage is below an upper threshold, and a large transconductance when this difference is above this upper threshold.

8. The series voltage regulator as in claim 6, wherein the transconductance circuit has a transconductance characteristic which has a large transconductance when the difference between the regulator input voltage and the regulator output voltage is above an upper threshold.

9. The series voltage regulator as in claim 1, wherein the transconductance circuit is designed as a differential circuit, having a first input which is connected to the input connection of the series voltage regulator, which is connected to the regulating transistor, and a second input which is connected to the output connection of the series voltage regulator, which is connected to the regulating transistor.

10. The series voltage regulator as in claim 9, wherein the differential circuit is formed by a differential amplifier circuit.

11. The series voltage regulator as in claim 9, wherein an auxiliary voltage source is connected between the input connection and the first input of the differential circuit.

12. The series voltage regulator as in claim 11, wherein the auxiliary voltage source delivers a constant voltage.

13. The series voltage regulator as in claim 11, wherein the differential circuit has two transistors arranged in a differential amplifier circuit, the base of the first transistor is connected to the auxiliary voltage source and the base of the second transistor is connected to the output connection, the emitter of the first transistor is connected via a first current source, and the emitter of the second transistor is connected via a second current source, to the input connection, the emitters of the two transistors are connected with each other via an emitter impedance, and the capacitor is connected to the output of a summing circuit whose inputs are connected to the collector of the first transistor and to the collector of the second transistor, respectively.

14. The series voltage regulator as in claim 13, wherein the summing circuit has a current mirror circuit whose input is connected to the collector of the first transistor and whose output is connected to a connecting point between the collector of the second transistor and the capacitor.

15. The series voltage regulator as in claim 13, wherein the first and the second transistor are each designed as a multi-transistor with at least two collectors with greatly varying collector areas and each collector with the smaller collector area is connected to the summing circuit.

16. The series voltage regulator as in claim 13, wherein the auxiliary voltage source has a series circuit comprising a second voltage divider and a third current source, the connecting point between the second voltage divider and the third current source being connected to the base of the first tansistor, and the collector-to-emitter path of a third transistor is connected between the base of the second transistor and the collector, which is connected to the summing circuit of the first transistor, the base of this third transistor being connected via a diode path to a divisional voltage point of the second voltage divider.

17. The series voltage regulator as in claim 16, wherein the summing circuit has a current mirror circuit whose input is connected to the collector of the first transistor and whose output is connected to a connecting point between the collector of the second transistor and the capacitor.

18. The series voltage regulator as in claim 16, wherein the first and the second transistor are each designed as a multi-transistor with at least two collectors with greatly varying collector areas and each collector with the smaller collector area is connected to the summing circuit.

19. The series voltage regulator as in claim 18, wherein the summing circuit has a current mirror circuit whose input is connected to the collector of the first transistor and whose output is connected to a connecting point between the collector of the second transistor and the capacitor.

20. The series voltage regulator as in claim 13, wherein the emitter impedance is formed by a series circuit of two resistors and the emitter path of a fourth transistor is connected between the emitter of the first transistor and the collector, which is connected to the summing circuit of the second transistor, the base of this fourth transistor being connected to the connecting point between the two resistors of the emitter impedance.

21. The series voltage regulator as in claim 16, wherein the emitter impedance is formed by a series circuit of two resistors and the emitter path of a fourth transistor is connected between the emitter of the first transistor and the collector, which is connected to the summing circuit of the second transistor, the base of this fourth transistor being connected to the connecting point between the two resistors of the emitter impedance.

22. The series voltage regulator as in claim 17, wherein the emitter impedance is formed by a series circuit of two resistors and the emitter path of a fourth transistor is connected between the emitter of the first transistor and the collector, which is connected to the summing circuit of the second transistor, the base of this fourth transistor being connected to the connecting point between the two resistors of the emitter impedance.

23. The series voltage regulator as in claim 18, wherein the emitter impedance is formed by a series circuit of two resistors and the emitter path of a fourth transistor is connected between the emitter of the first transistor and the collector, which is connected to the summing circuit of the second transistor, the base of this fourth transistor being connected to the connecting point between the two resistors of the emitter impedance.

24. The series voltage regulator as in claim 19, wherein the emitter impedance is formed by a series circuit of two resistors and the emitter path of a fourth transistor is connected between the emitter of the first transistor and the collector, which is connected to the summing circuit of the second transistor, the base of this fourth transistor being connected to the connecting point between the two resistors of the emitter impedance.

* * * * *